US009214734B2

(12) United States Patent
Huynh

(10) Patent No.: US 9,214,734 B2
(45) Date of Patent: Dec. 15, 2015

(54) MULTI-QUADRIFILAR HELIX ANTENNA

(75) Inventor: Son Huy Huynh, Redondo Beach, CA (US)

(73) Assignee: NovAtel Inc., Calgary (CA)

( * ) Notice: Subject to any disclaimer, the term of this patent is extended or adjusted under 35 U.S.C. 154(b) by 184 days.

(21) Appl. No.: 13/273,383

(22) Filed: Oct. 14, 2011

(65) Prior Publication Data

US 2012/0092227 A1 Apr. 19, 2012

Related U.S. Application Data

(60) Provisional application No. 61/392,992, filed on Oct. 14, 2010.

(51) Int. Cl.

| | |
|---|---|
| ***H01Q 1/36*** | (2006.01) |
| ***H01Q 11/08*** | (2006.01) |
| ***H01Q 5/371*** | (2015.01) |
| ***H01Q 5/378*** | (2015.01) |

(52) U.S. Cl.
CPC ..... *H01Q 11/08* (2013.01); *H01Q 5/371* (2015.01); *H01Q 5/378* (2015.01)

(58) Field of Classification Search
USPC ..... 343/859, 895, 702
See application file for complete search history.

(56) References Cited

U.S. PATENT DOCUMENTS

| | | | | |
|---|---|---|---|---|
| 4,008,479 A | | 2/1977 | Smith | |
| 4,554,554 A | | 11/1985 | Olesen et al. | |
| 4,608,574 A | | 8/1986 | Webster et al. | |
| 5,212,494 A | | 5/1993 | Hofer et al. | |
| 5,872,549 A | * | 2/1999 | Huynh et al. | 343/895 |
| 6,421,028 B1 | * | 7/2002 | Ohgren et al. | 343/895 |
| 2010/0231480 A1 | * | 9/2010 | Leisten | 343/895 |

FOREIGN PATENT DOCUMENTS

| | | |
|---|---|---|
| WO | WO 96/18220 | 6/1996 |
| WO | WO 97/06579 | 2/1997 |
| WO | WO 99/33146 | 7/1999 |

* cited by examiner

*Primary Examiner* — Hoang V Nguyen
*Assistant Examiner* — Hai Tran
(74) *Attorney, Agent, or Firm* — Cesari and McKenna, LLP

(57) ABSTRACT

In accordance with one or more embodiments of the present invention, a quadrifilar helix antenna can be formed to accommodate multiple frequencies using a single microstrip feed system, illustratively comprising an infinite balun in combination with interspersed antenna conductors tuned for effective resonance at the desired frequencies around the single feed system. Accordingly, as an additional aspect, the present invention also combines the multiple frequency antenna elements and the single feed system into a unitary assembly of cylindrical geometry that is generally reduced in size, with the interspersed arrangement of the multiple (e.g., resonating) antenna conductors wrapped into a short cylindrical surface. Through the use of the single hybrid feed system and resonating antenna conductors for multiple frequencies, the need for complex feed networks having multiple circuits (hybrid circuits, transformers, etc.) is alleviated, while still maintaining acceptable levels of performance.

20 Claims, 8 Drawing Sheets

MULTI-QUADRIFILAR HELIX ANTENNA

CROSS-REFERENCE TO RELATED APPLICATIONS

The present application claims the benefit of U.S. Provisional Patent Application Ser. No. 61/392,992, which was filed on Oct. 14, 2010, by Son Huy Huynh for a MULTI-QUADRIFILAR HELIX ANTENNA and is hereby incorporated by reference.

FIELD OF THE INVENTION

The invention relates generally to antennas, and, more particularly, to quadrifilar helix antennas and balun feed networks.

BACKGROUND INFORMATION

An antenna in its most basic form is a transducer designed to transmit or receive electromagnetic waves, thus converting electromagnetic radiation into electrical current, or vice versa. In particular, the electrical length of an optimum antenna element is related to the frequency of the signal that the antenna is designed to transmit or receive, i.e., the resonant frequency and electrical resonance of an antenna is related to the electrical length of the antenna element. The electrical length is usually the physical length of the element divided by its velocity factor (the ratio of the speed of wave propagation in the element to the speed of light). Typically, an antenna is tuned for a specific, resonant frequency, and is effective for a range of frequencies that are centered on the resonant frequency. Notably, however, other properties (e.g., the radiation pattern and impedance) of an antenna change with frequency, so the antenna may be optimized for an overall response at a desired frequency.

As is well understood in the art, the wavelength ($\lambda$) of an electromagnetic wave is calculated as the speed of light (C, roughly $3\times10^8$ m/s) divided by the frequency (f). Antennas are often designed with antenna elements that have an electrical length equal to a wavelength of interest, or a fraction of the wavelength (e.g., ½, ¼, ⅛, etc.) based on the properties of a transmitted or received signal, such as polarization and so forth. While an antenna will, for example, still transmit if the electrical length is not ideal for resonance, less of the power provided by the transmitter will actually become a useful output signal. Accordingly, the antenna will have reduced efficiency.

A dipole antenna is a well known type of antenna and consists of two element "halves" that are center fed. Generally, each half of the dipole antenna is roughly ¼ wavelength long, and with the antenna being fed from its center, the total electrical length is ½ wavelength long. Also, due to the configuration of a dipole antenna (that is, where the ends of the antenna correspond to anti-nodes and the center to nodes), the antenna resonates well. Dipole antennas are considered balance devices because they are symmetrical and work best when they are fed with a balanced current. In other words, the current is of equal size on both halves (e.g., and phase shifted 180 degrees). This is usually accomplished when the antenna is fed with an unbalanced feed, such as a coaxial cable, through a type of circuit or transformer called a balun (from BALanced and UNbalanced). Notably, the optimum size of a dipole antenna is slightly different than would be expected based on wavelength alone, due to the interaction of the balun and the antenna elements. However, the length is relatively close to the predicted length for optimum broadcast efficiency.

To achieve superior performance in many different scenarios, a type of cylindrical antenna known as a quadrifilar helix antenna (QHA) has been used for various types of communication, such as satellite systems. The quadrifilar helix antenna is generally composed of four identical antenna elements in the form of helixes wound, equally spaced, on a cylindrical surface. For transmitting, the helixes may be fed with signals equal in amplitude and 0, −90, −180, and −270 degrees in relative phase to produce circularly polarized electromagnetic radiation in the radio frequency or "RF" wavelengths. The QHA antenna provides a generally hemispherical radiation pattern (a signal polarized both vertically and horizontally). The QHA antennas are generally attractive for their small size and light weight, which makes them suitable for certain applications, such as for use with handheld handsets, also referred to as handhelds.

A stacked quadrifilar helix antenna, in particular, incorporates two QHA antennas, one located adjacent the other along the same cylindrical axis. For example, in an illustrative implementation, an upper antenna may serve the transmission of RF energy at one frequency and a lower antenna may be used to transmit or receive RF energy at another frequency. Often these frequencies may fall within the microwave frequency range, but the antenna may be designed for other frequencies as well. An example stacked QHA antenna and corresponding feed network is shown in U.S. Pat. No. 5,872,549, issued on Feb. 16, 1999 to Huynh et al. ("the '549 patent"), the content of which incorporated herein by reference in its entirety. In particular, the '549 patent describes an advanced form factor that uses a microstrip balun structure to reduce the size of the antenna's feed network.

While the '549 patent illustrates one manner to reduce the size of stacked quadrifilar helix antennas, there generally remains an ongoing desire to further reduce the size of an antenna's package for convenience and aesthetics, and to reduce manufacturing cost and complexity, while also maintaining acceptable levels of performance.

SUMMARY OF THE INVENTION

In accordance with one or more embodiments of the present invention, a quadrifilar helix antenna can be formed to accommodate multiple frequencies using a single microstrip feed system, illustratively comprising an infinite balun in combination with antenna conductors tuned for effective resonance at the desired frequencies around the single feed system. Accordingly, as an additional aspect, the present invention also combines the multiple frequency antenna elements and the single feed system into a unitary assembly of cylindrical geometry that is generally reduced in size, with an interspersed arrangement of the multiple (e.g., resonating) antenna conductors wrapped into a short cylindrical surface. The antenna is thus not a stacked arrangement.

Advantageously, the present invention utilizes a single hybrid feed system, and thus does not require multiple circuits for multiple frequencies. In particular, through the use of a properly tuned infinite balun and the respective resonating antenna conductors, a complex feed network of multiple hybrid circuits and matching transformers is no longer required. Moreover, the physical design of the invention provides a compact light-weight unitary assembly, essentially of the shape of a short rod, that may be attached to vehicles or handhelds used in communication and/or GNSS systems.

BRIEF DESCRIPTION OF THE DRAWINGS

The invention description below refers to the accompanying drawings, of which.

DETAILED DESCRIPTION OF ILLUSTRATIVE EMBODIMENTS

According to the present invention, a quadrifilar helix antenna may be tuned for multiple frequencies using a single feed system, where the antenna elements and antenna couplers for the multiple frequencies are arranged to share the same cylindrical space, without stacking. That is, while previous quadrifilar helix antennas have been designed to provide a stacked arrangement, having a transmitting or receiving antenna and corresponding feed system on top of a transmitting or receiving antenna and corresponding feed system tuned for a different frequency, the embodiments herein allow the antenna elements for the multiple frequencies (e.g., transmit and receive or otherwise) to share a common planar surface area and share the same feed system, greatly reducing the overall physical dimension, and in particular the "height", of the antenna. Further, the use of a single feed system significantly reduces the cost and complexity of the antenna over those multi-frequency antennas that utilized complex feed systems including multiple baluns and transformers for each frequency, the present invention allows the use of a single feed system.

The antenna utilizes an infinite balun and also resonant coupling between primary frequency antenna conductive elements (or "arms") and the elements for one or more secondary frequencies, such that when the primary antenna elements resonate at a first frequency, the secondary antenna elements, which are tuned for distinct second, third and so forth frequencies, also resonate and vice versa. The infinite balun and resonant coupling will be discussed in more detail below.

Figure 1A:
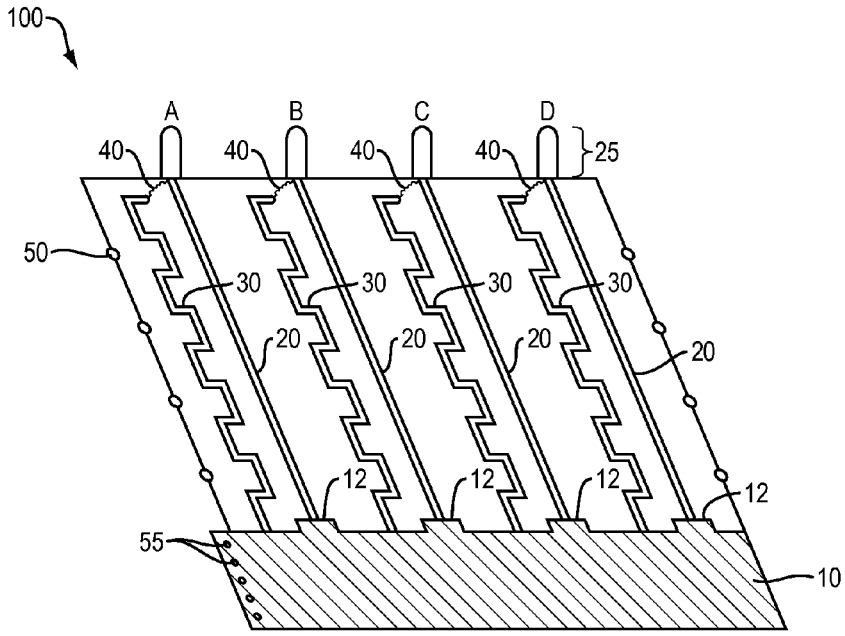
FIG. 1A illustrates one side of a first example antenna in an unrolled view in accordance with the invention.
Figure 1B:
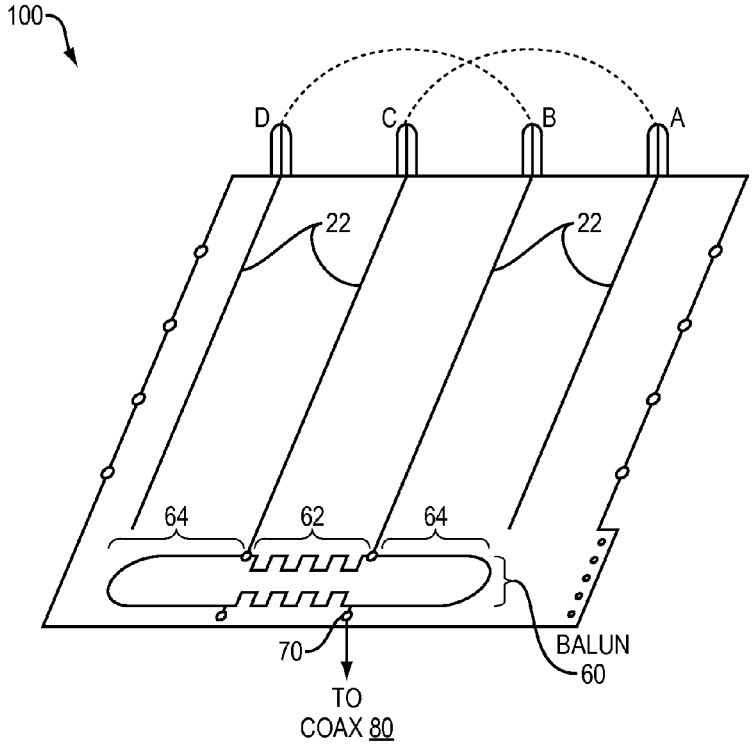
FIG. 1B illustrates another side of the first example antenna in an unrolled view in accordance with the invention.
Figure 1C:
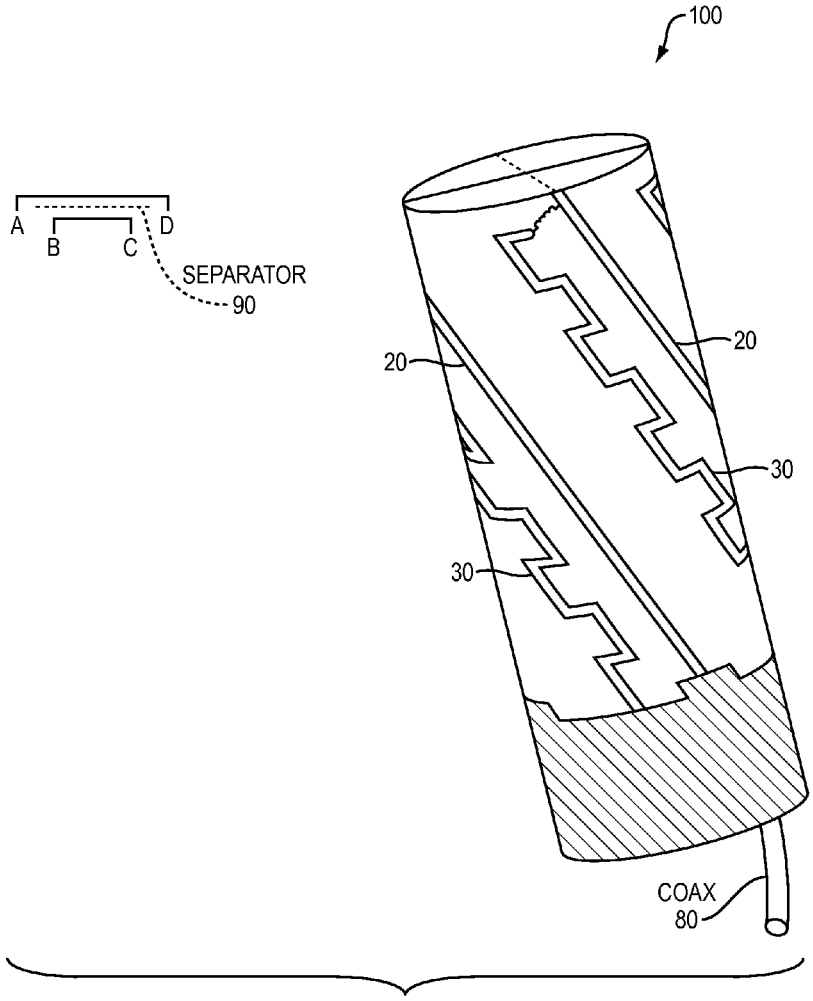
FIG. 1C illustrates the first example antenna in a rolled view in accordance with the invention.

FIGS. 1A-C illustrate an example embodiment of a multi-quadrifilar helix antenna 100 in accordance with one or more embodiments of the present invention. For example, as shown in FIG. 1A, the antenna is illustrated unwrapped from a cylinder shape (of FIG. 1C) and flattened, in an essentially two-dimensional layout view. The subassembly may include various electrical elements, as described in more detail below, that are formed on a sheet of flexible electrical insulator with the requisite dielectric properties as a two dimensional laminate, and wrapped 360 degrees around to form the cylindrical antenna shown in FIG. 1C.

Antenna 100 comprises four straight "primary" conductive elements 20 (e.g., A-D), spaced evenly and parallel to one another at a slight angle to a horizontal upper or lower edge, attached or plated on the insulative sheet (substrate) 5 (e.g., having a thickness of 0.010 inches). The conductive elements or "arms" 20 extend generally between a ground plane 10 and portions or "tabs" 25 that extend beyond the substrate 5, and are spaced to correspond to different phases of the desired frequency (e.g., one arm per quadrant, as described below). As illustrated the distance between the right hand side of conductor D and right hand edge of the base 5 plus the distance between the left hand side of conductor A and the left hand edge of base layer 5 is the same as that spacing between conductors A and B, B and C, and C and D. That is, if one visualizes wrapping the illustrated arrangement into a cylinder as described below with reference to FIG. 1C, the antenna's primary conductors 20 are spaced evenly about the axis of the cylinder. In addition, each conductor winds spirally about the tube at the prescribed angle, in total, defining a fractional turn, e.g., one-half turn, quadrifilar helix antenna.

The antenna 100 is designed to act as a dual-frequency antenna, and as such, in addition to the primary arms 20, secondary conductors/arms 30 may also be disposed on the substrate 5. Specifically, in accordance with the present invention, each of the arms 25 and 30 may be tuned for a second frequency, e.g., being approximately ½ wavelength (or other well-suited tuning length) in order to receive and/or transmit a particular signal strongly at the corresponding frequency. For instance, illustrative frequencies may be those of the L1 and L2 bands of GNSS (Global Navigation Satellite Systems) signals, namely 1575.42 (+/−15) MHz and 1227.60 (+/−15) MHz, respectively. Note that secondary arms 30 may also correspond to quadrant phases of the corresponding frequency, and thus may be arranged as four equally spaced conductors at roughly the same angle as the primary arms 20 to create the circularly polarized helix antenna.

Regardless of the actual frequencies, the primary frequency is generally a higher frequency than the secondary frequency, and thus will have a correspondingly shorter wavelength and resultant antenna conductor/arm length than the secondary frequency. Accordingly, the conductors 20 and 30 may be arranged to allow for the correct lengths corresponding to the frequencies. For instance, the shorter arms 20 may be straight length arms, while the longer arms 30 may be arranged in a serpentine or "curvy" orientation to allow for greater electrical length within the same "height" constraint of the antenna's surface area. Other techniques to adjust the effective electrical length of the antenna conductors may include ground adjusts 12, which shorten the electrical length of the conductor by attaching at a mid point to the ground plane 10.

Referring now to FIG. 1B, illustrating the reverse side (interior, ground plane) of the antenna 100, the feed system for the antenna comprises a single infinite balun 60 interconnected to two of four electrical leads or antenna "stems" 22 (A-D), which correspond to arms 20 (A-D). As described further below, during reception, the leads supply a received circularly polarized signal from the antenna to the balun, which converts the circularly polarized signal to a linear one that is suitable for transmission through feed pin 70 onto a coaxial line 80. The coaxial cable connects in turn to external receiver circuits (not shown). During transmission, a linearly polarized signal received from the coaxial cable 80 is converted by the balun 60 into a circularly polarized signal, which is fed to the leads for transmission by components 20 and 22.

Baluns, generally, act as converters between mismatch impedance components, such as an unbalanced coaxial cable leading to a balanced antenna (e.g., dipole antennas, quadrifilar helix antennas, etc.), through designed electro-magnetic coupling. In other words, a balun is a passive RF matching device that converts a transmission line carrying the transmit and/or receive signals, such as a coaxial cable, strip line or microstrip and the like, into a balanced feeder. At high (e.g., microwave) frequencies, resonant transmission lengths the in balun act as wave traps and incorporated feed phase inverters. The balun is essentially an equal power divider, in the case of transmitted waves, and an equal power combiner in the case of received waves, having perfect return loss at the input, no matter what kind of electrical impedance appears at the outputs. Since antennas and feed-lines each have characteristic impedances, it is ideal that the balun match the impedances perfectly so that 100% of the energy sent to the antenna is converted to radio energy. If not, some energy is not converted and is instead reflected back down the feed line, causing standing waves (where the ratio of standing waves to transmitted waves is known as a standing wave ratio, SWR). Minimizing impedance differences at each interface (impedance matching) will reduce SWR and maximize power transfer through each part of the antenna system. More commonly, the impedance is adjusted at the load with an antenna tuner, a balun (as in the present invention), a matching transformer, matching networks composed of inductors and capacitors, or matching sections such as the gamma match.

In addition to achieving a "max/min" signal with maximized power transfer and minimal reflection (e.g., without any reflection), the use of a infinite balun 60 (and infinite loop) as described herein alleviates the need for transformers in the feed circuitry, and by design is the only feed system required for multiple phases and frequencies. That is, previous systems, such as the stacked quadrifilar helix antenna mentioned above, required separate feed systems for each frequency (e.g., three to achieve four phase shifted signals), and these separate feed systems each required the use of transformers. Using a single infinite balun, however, allows for a smaller and less complex circuit, and results in less signal loss. The antenna can thus be smaller and more attractive for handheld use.

The balun 60 is designed to feed a signal of a particular frequency in two portions that are 90 degrees out of phase from each other (e.g., to arms B and C). As described further below, particularly with reference to FIG. 1C, the tabs 25 of certain corresponding arms 20 are interconnected (e.g., B to D and C to A), such that by feeding the two stems B and C signals that are 90 degrees out of phase, the end result when in cylindrical form is four arms emitting the signal, each 90 degrees out of phase from an adjacent arm, i.e., a circularly polarized signal. In other words, the energy leaving the balun 60 enters a closed loop system (thus not requiring a transformer), that is similar to a feedback loop.

To achieve the 90 degree separation between the two fed arms is an illustrative balun geometry as shown. For instance, by combining different electrical length segments, such as "straight" segments 64 and "serpentine" or "curvy" segments 62, different angles of the signal result at the two intersections with the arms (stems) B and C. Note that the serpentine design of segment 62 allows for efficient utilization of limited space constraints. Other designs may be possible that achieve the same phase differential, and in addition, other designs that place the connections between the balun and arms A and D, or A and B, or C and D, suitably configured with respective phase differentials, may also be used with the antenna 100 and remain within the scope of the present invention.

The signal distance between each connection on either side of illustrative segment 62, in particular, represents a length substantially equal to one quarter wavelength at the signal frequency for which the balun is designed for use with the multi-frequency antenna. Since the balun 60 is meant to feed multiple frequencies, it may be beneficial to tune the balun to a frequency between the two or more frequencies. For instance, the balun frequency may be in the middle of the two frequencies, or may be some other average (e.g., weighted) of the frequencies of the antenna. By having the balun tuned to a frequency close to each of the frequencies for which the antenna elements are designed, transformers are not needed. Notably, a single infinite balun may be used for multiple frequencies simultaneously due to its scalable bandwidth.

Referring again to FIG. 1A, since the balun 60 is only interconnected to arms 20 (through stems 22) for the primary frequency, a means for the energy to reach the secondary arms 30 is described. Through well-placed proximity, mutual inductance may occur between the primary and secondary arms of the antenna. To create a tight coupling between the primary arms and the secondary arms, an inductive coupling may be established to ensure resonation of the primary arms at the secondary frequency, thus the two separate antenna circuits effectively become one. It has been determined that an appropriately valued inductor 40 may be placed between each corresponding arms 20/30 in order to allow proper resonation between the primary and secondary frequencies, and to control the flow in a desired manner. Capacitance, it has been found, may produce the same desired result. Note that it has also been determined that an optimal placement of the inductors 40 is at the distal ends of the arms (away from ground plane 10) in order to couple the signals between the first and second arms.

In this manner, when a signal of the second frequency is received by the secondary conductors 30, it resonates onto the primary conductors 20 and is received by the balun 60. When a signal of the primary frequency is received by the primary conductors 20, it is received by the balun 60 with essentially no coupling to the secondary conductors. Conversely, when a signal of the first frequency is transmitted through the balun 60, it is propagated through the primary conductors 20, while a signal transmitting at the secondary frequency is propagated through the primary conductors 20 and via inductors 40 to secondary conductors 30, which operate at increased efficiency at the secondary frequency. This arrangement advantageously allows for separation of the first and second frequency signals.

Referring to FIG. 1C, the antenna 100 forms a single piece three-dimensional cylindrical structure or envelope as illustrated in the perspective view shown. The assembly contains the multiple antenna elements 20 and 30 which are tuned for separate frequencies, as well as the associated feed network (balun 60) and resonance coupling in a spatially overlapped helix antenna array. In the illustrative example using the illustrative frequencies mentioned above, an approximate height of the multiple frequency antenna is 3.25 inches.

As mentioned above, the circuit patterns may be formed on a parallelogram-shaped flexible substrate 5, e.g., comprising a dielectric sheet, which is then rolled around to form a cylindrical tube (e.g., using physical connectors 50 along opposing edges of the substrate, and connections 55 of ground plane 10, each as shown in FIG. 1A). The substrate may be physically attached to an underlying tube for additional support, such as being wrapped around the tube rather than in free space to form its own tube, or may be inserted into a structural tube, such as a pre-shaped cylindrical radome. Alternatively, the elements may be formed by direct application to a dielectric tube, e.g., using a plating and laser etch technique to a pre-formed tubular substrate. Example tubing materials comprise glass epoxy tubes, polycarbonate tubes, and injection mold tube formations, such as a polyetherimide or a polycrysulfone.

As mentioned above, tabs 25 may be folded or otherwise caused to interconnect at the top of the antenna assembly 100, in a manner that creates two sets of separate interconnections, forming a cross-dipole arrangement. In other words, laterally opposing arms may be interconnected in order to match the phase of the signal 180 degrees, thus translating the 90 degree balun offset from above into 0 and 180 degree interconnected arms as well as 90 and 270 degree interconnected arms. Specifically, arm/tab A is interconnected (e.g., soldered) to arm/tab C, while arm/tab B is interconnected to arm/tab D, thus resulting in one antenna arm 20 and 30 in each phase quadrant. These interconnections may be kept separate through a separator 90 (shown in the inset of FIG. 1C), such as a non-conductive tape or other suitable material. The two segments A-C and B-D combine together to create a closed loop system, alleviating the need for a transformer as mentioned above.

When the antenna elements are fed energy at a certain frequency, through the balun 60, each of the four arms (being ninety degrees out of phase with each adjacent arm) of the quadrifilar helix antenna 100 that correspond to that certain frequency emits energy that results in a circularly polarized signal. Notably, when emitting energy from the secondary arms 30, the signal is fed by the balun 60 to primary arms 20 and through inductors 40 provided to secondary arms 30, as noted above. When receiving radio energy at a certain frequency to which a set of arms (20 or 30) is tuned, this energy is relayed to the balun 60, which feeds the signal to the coaxial cable 80 to receipt by external circuitry. Specifically, when the secondary arms 30 receive a signal at their corresponding frequency, inductors 40 provide the signal to primary arms 20, which then relay the signal to balun 60, again as noted above. The result is a quadrifilar helix antenna responsive to multiple frequencies, using a single feed network, and allowing both the conductors 20/30 of the multiple frequencies to share the same substrate's height. One illustrative use of such an antenna allows signal transmission at one frequency and independent signal reception at another frequency. Another is the efficient reception of two different frequencies (i.e., without transmission on either frequency) or transmission of two different frequencies (i.e., without reception on either frequency).

Figure 2A:
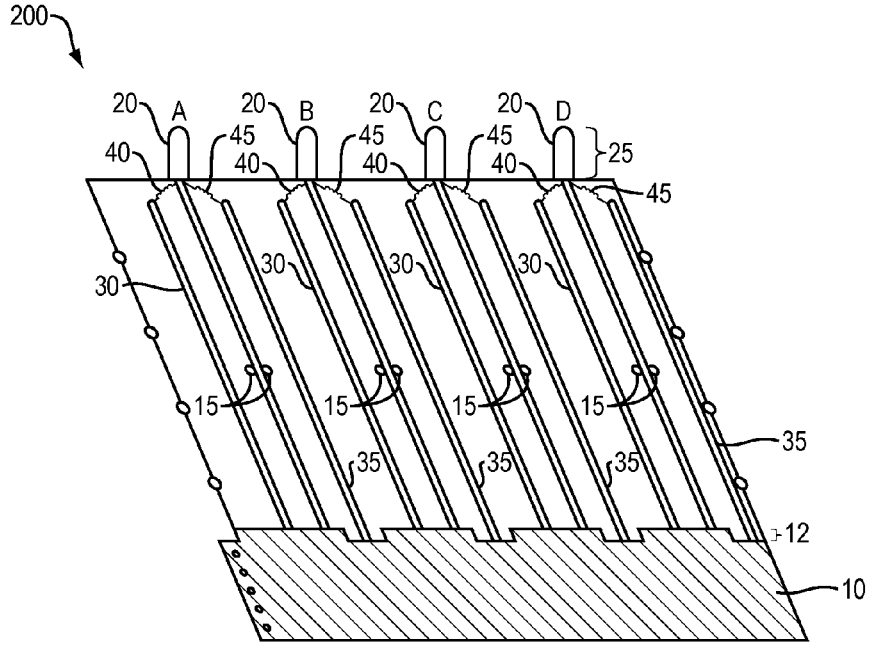
FIG. 2A illustrates one side of a second example antenna in an unrolled view in accordance with the invention.
Figure 2B:
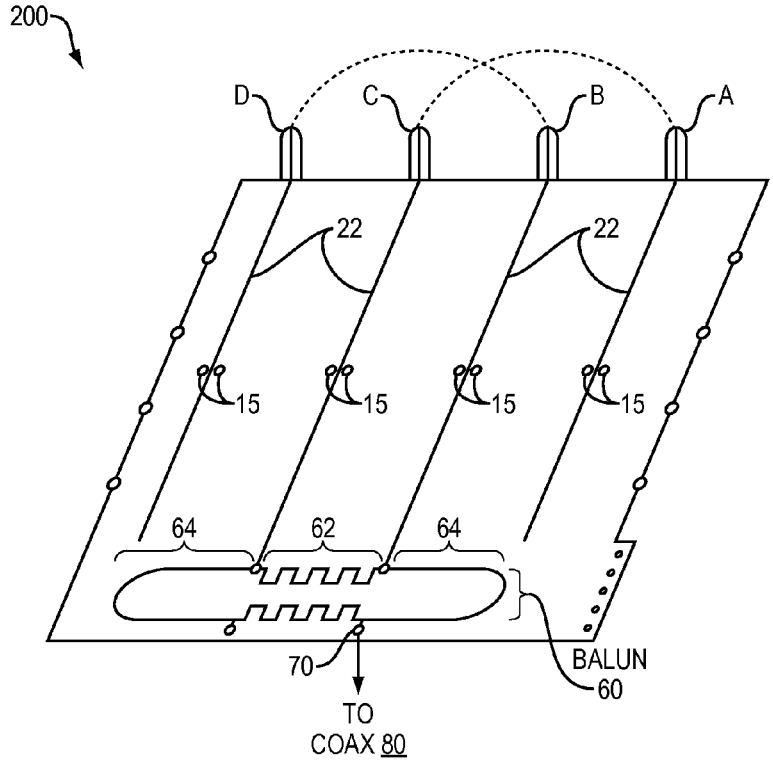
FIG. 2B illustrates another side of the second example antenna in an unrolled view in accordance with the invention.
Figure 2C:
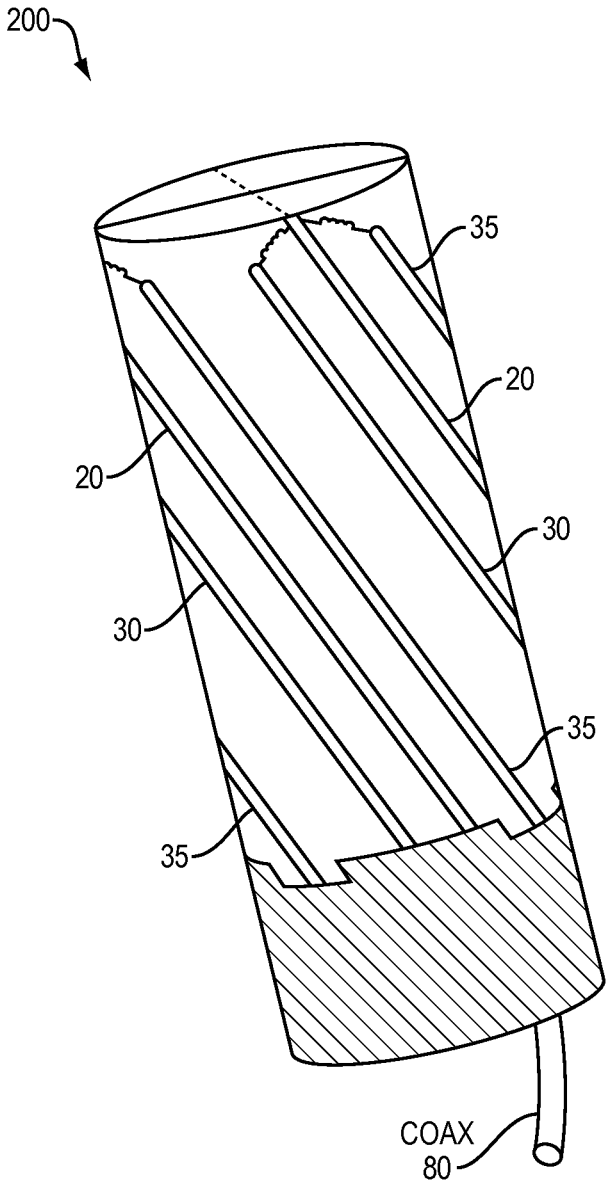
FIG. 2C illustrates the second example antenna in a rolled view in accordance with the invention.

Other embodiments of the present invention are illustrated in FIGS. 2A-C, which show an antenna 200 designed for three frequencies. In particular, the embodiment shown is an antenna 200 that comprises four primary arms 20, which are, respectively, flanked by four secondary arms 30 to one side and four secondary arms 35 of a different tuned length on the other side (totaling twelve arms). This arrangement allows for the antenna 200 to manage three frequencies, particularly by coupling the primary signal and an additional secondary signal through the inductors 45. The third signal (the additional secondary signal) may be provided through resonation at a third frequency in a similar manner as described above with regard to the second frequency, such that a second inductor 45 may be added in order to couple the primary signal conductors to the third signal conductors. Note that the third signal (third frequency) and any additional signals may be slightly weaker than the first and second signals, but the reduced power may be sufficient for certain applications.

Illustratively, all of the arms are shown on antenna 200 as straight arms, contrary to the straight arms 20 and serpentine arms 30 of antenna 100 above. To achieve the differential lengths for multi-frequency tuning, antenna 200 ground adjusts 12 may again be used, perhaps more dramatically, as well as additional features such as ground shorts or "pinches" 15. For instance, by "pinching" an arm (e.g., primary arm 20) at an appropriate location, meaning that the arm is directly connected through the substrate (e.g., through a conductive hole) to the ground plane 10 of the reverse/interior side of the antenna, the effect results in a shorter arm length tuned for the desired frequency. As shown, the primary arms 20 contain ground pinches 15, dramatically reducing their length with respect to the secondary arms 30 and 35, which, in the example do not have ground pinches. Secondary arms 30 and 35, on the other hand, are differentiated in length by ground adjusts 12. Notably, while the embodiment in FIG. 2A illustrates all straight arms, certain embodiments may also include some straight arms, some serpentine arms, some ground pinched arms, some ground adjusted arms, etc., all of which fall within the scope of the present invention. For example, the primary arm 20 may be straight and ground pinched, the second arm 30 may be straight, and the third arm 35 may be at least partially serpentine, etc. Also, the orientation of the second and third arms on the left or right of the primary arm is merely illustrative, and is not meant to limit the scope of the present invention.

FIG. 2B illustrates the reverse side (e.g., interior side) of the antenna 200, which shares a design with antenna 100 of FIG. 1B. That is, a single feed network/balun 60 may be interconnected with the primary arms 20, and the primary arms are connected through inductors 40 to communicate with the secondary arms 30/35, which then resonate at their respective frequencies as well. One difference with antenna 100 as shown is the ground shorts 15 appearing through the substrate to the ground plane of the antenna's interior portion of FIG. 2B. Further, FIG. 2C illustrates the antenna 200 in cylindrical form. Note that an example height of the antenna 200 with straight arms and tuned to the same frequencies as antenna 100 may be approximately 4.25 inches.

Figure 3A:
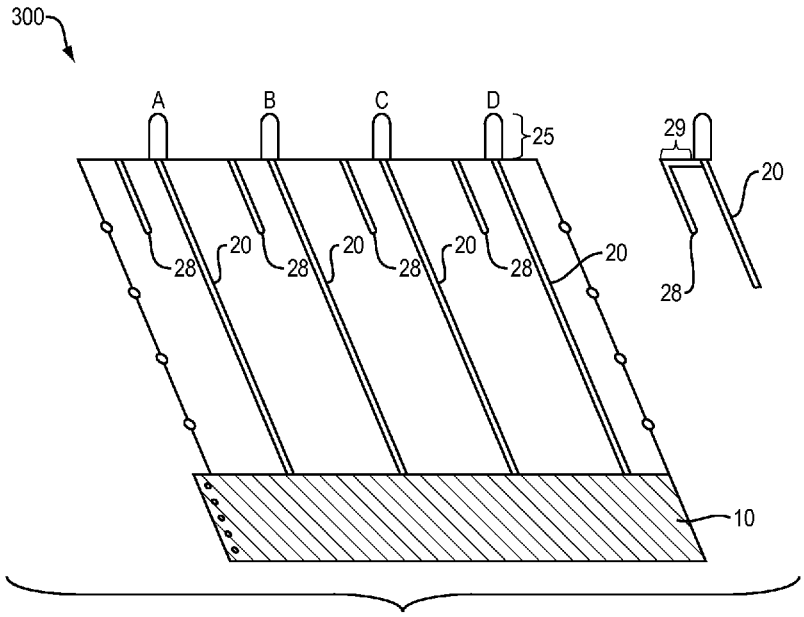
FIG. 3A illustrates one side of a third example antenna in an unrolled view in accordance with the invention.
Figure 3B:
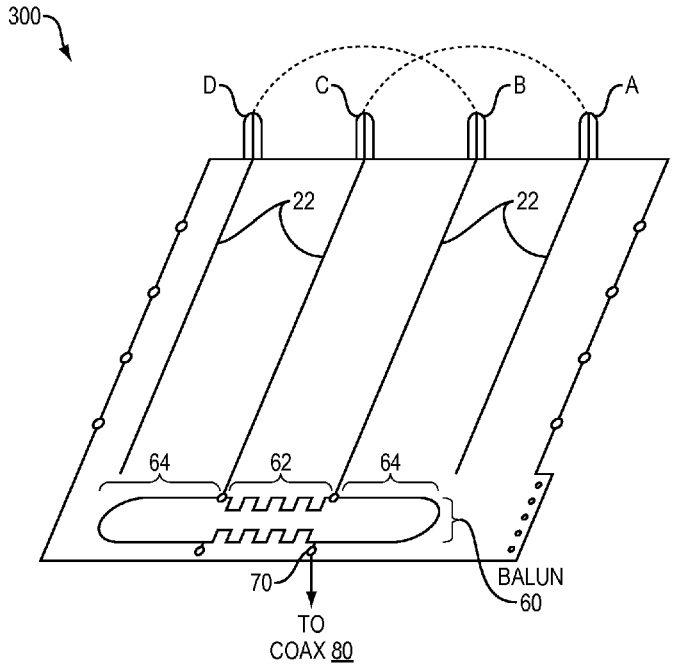
FIG. 3B illustrates another side of the third example antenna in an unrolled view in accordance with the invention.
Figure 3C:
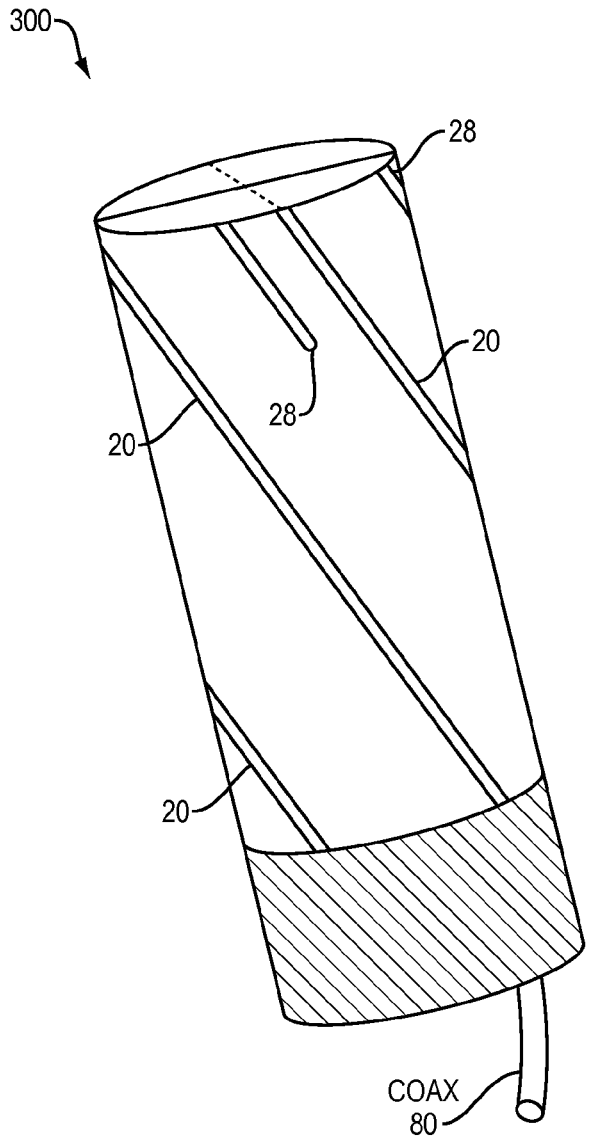
FIG. 3C illustrates the third example antenna in a rolled view in accordance with the invention.

An additional embodiment of the multi-quadrifilar antenna 300 is shown with reference to FIGS. 3A-C, in which "extension arms" 28 may be included to extend the electrical length of the elements and/or allow resonation for broader bandwidth. In particular, these extension arms 28 may be interconnected through mutual inductance with the primary arms 20 of the antenna 300. As shown in FIG. 3A, these arms may be manufactured as separate arms initially, or as shown in the inset portion of FIG. 3A, as initially interconnected arms, such that portion 29 of material (e.g., the conductive material alone or in combination with the underlying substrate) in order to separate the arms. The other side of the antenna as shown in FIG. 3B need not be any different than FIG. 1B or 2B, and FIG. 3C illustrates the antenna 300 in cylindrical form. Note that the length of the extension arms 28 may be specifically tuned to operate in conjunction with the primary arms 20 as shown (e.g., fractional wavelengths), or for secondary arms 30/35 of the other embodiments described above as desired (not shown for clarity). For example, rather than the three frequency antenna 200 of FIG. 2A, a dual frequency antenna 100 may include a third row of extension arms 28 in mutual inductance relation to the primary arm 20 or secondary arm 30 to add bandwidth to the related frequency, accordingly.

Figure 4A:
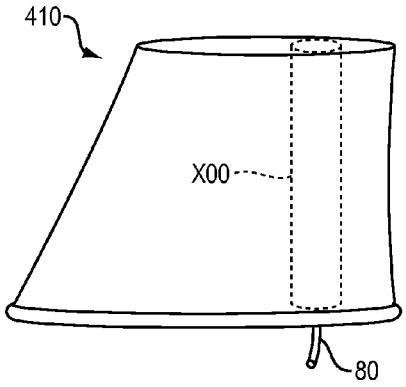
FIGS. 4A-4C illustrate example enclosures for the example antennas in accordance with the invention.
Figure 4B:
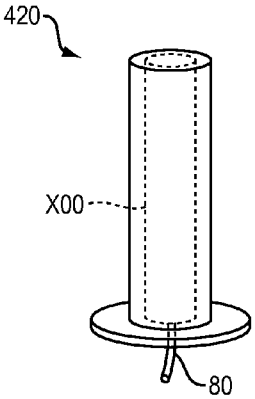
Figure 4C:
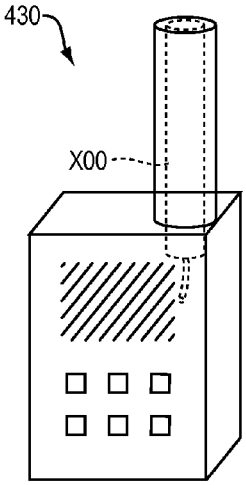

FIGS. 4A-4C illustrate example implementations of the formed (e.g., wrapped) antennas 100, 200, and 300 (shown as "X00"). Generally, as mentioned above, one desire of antenna manufacturers (or their customers) is to reduce the size of an antenna, in both length and diameter, while retaining acceptable radiation performance characteristics. The antenna embodiments herein (X00) may generally fall within a range of three to four inches in length, and roughly one-half inch in diameter, though any suitable sizes are within the scope of the invention. In FIG. 4A, for instance, the antenna X00 may be contained within a "blade" enclosure 410, e.g., for use in vehicular implementations. This implementation provides reduced wind resistance and is less visible on the vehicle than known dual or multiple frequency antennas operating in similar frequency ranges. Also, in FIG. 4B, a generally cylindrical enclosure 420 may surround the antenna X00 to protect it. The cylindrical enclosure 420 may also be place on a vehicle, or, as shown in FIG. 4C, may be configured for use with a hand-set (hand-held communication device) 430. Due to its small size, the antenna X00 may be particularly well-suited for such hand-held implementations.

Figure 5:
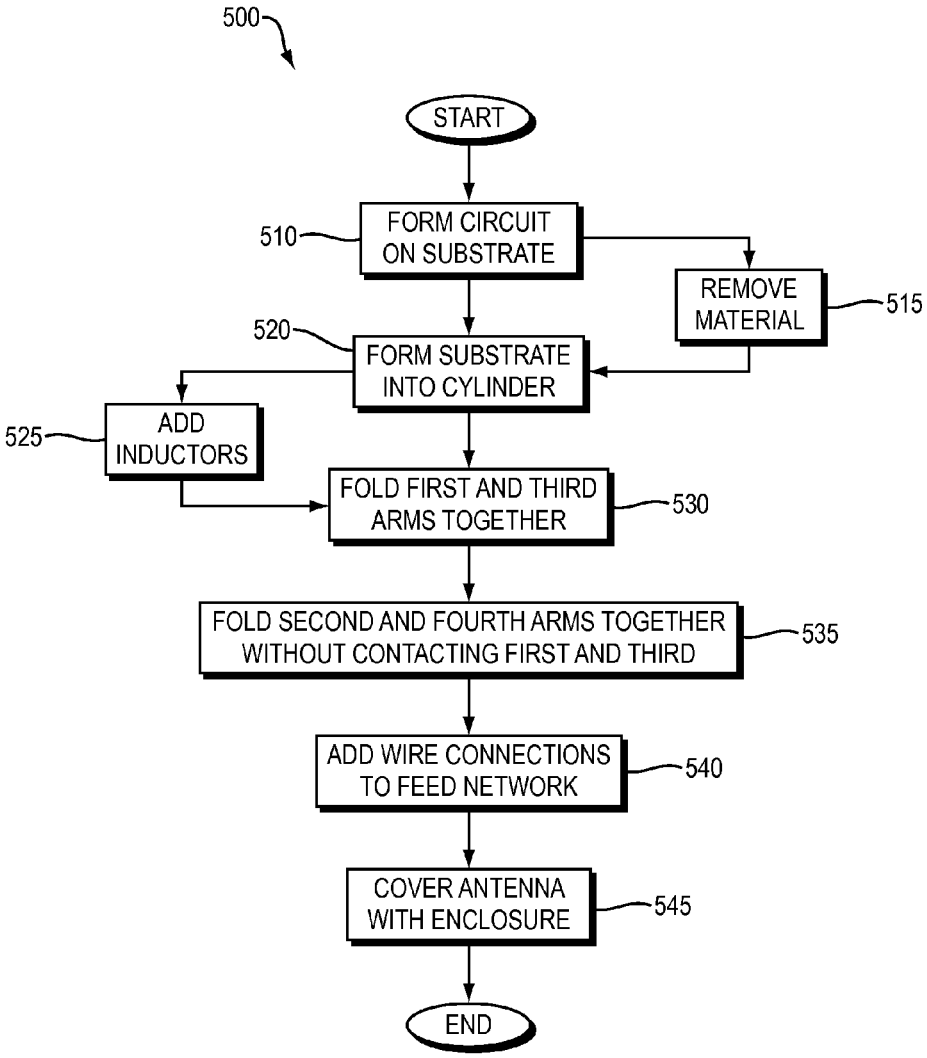
FIG. 5 illustrates example simplified procedure for making the antennas in accordance with the invention.

FIG. 5 illustrates an example simplified procedure for manufacturing the antenna embodiments described herein. The procedure 500 starts in step 505, and continues to step 510, where the antenna's circuitry may be formed on an underlying substrate (e.g., and material 29 may be removed in step 515, as shown in FIG. 3). The substrate may also be formed into the shape of a cylinder as illustrated above in step 520. For instance, the foregoing elements may be formed, using conventional printed circuit plating and etching technique in multiple layers as a laminate, on a single sheet of flexible electrically insulative material. Due to its characteristic flexibility, the dielectric sheet and the conductors plated thereon may be formed (rolled or wrapped) into the shape of a cylinder, e.g., wrapped around and bonded to a underlying cylinder structure or rolled independently and placed within an outer cylinder structure. As an alternative, the antenna may be formed directly upon a molded, e.g., non-metallic, cylinder using cutting and/or machining techniques known in the circuit board industry.

Once the circuit is cylindrical in shape, in step 525 (for embodiments 100 and 200) inductors may be added (e.g., soldered) to the appropriate locations of the antenna assembly. Further, in step 530, the first and third tabs 25 (e.g., A and C) may be folded over the top of the cylinder and interconnected (e.g., soldered), and in step 535 the remaining second and fourth tabs 25 (e.g., B and D) may be folded over the top of the cylinder and interconnected, electrically separated from the first and third tabs, as described above. (Note that steps 525-535 may occur in any order.)

Additionally, in step 540, wire connections (e.g., coax cables or interconnects) 80 may be added to the feed network/balun 60 (feed pin 70). If desired, an enclosure, such as a rubber jacket or other suitable protective covering, may be added to cover the antenna assembly in step 545. Note that this enclosure may include a first layer of enclosure to hold the elements of the antenna in place, as well as an outer enclosure 410 or 420 to protect the antenna from external physical influence (e.g., weather, physical shock, etc.). The procedure 500 then ends in step 550, with the antenna suitable for connection to communication circuitry and use.

Advantageously, in accordance with one or more embodiments of the present invention, novel arrangements of a quadrifilar helix antenna have been described that accommodate multiple frequencies using a single microstrip feed system (e.g., an infinite balun) in combination with interspersed antenna conductors that are tuned for effective resonance around the single feed system. In particular, as noted above, through the use of the single hybrid feed system and resonating antenna conductors, complex feed networks having multiple circuits (hybrid circuits, transformers, etc.) are not required for multiple frequencies. Further, the physical design of the invention provides a compact light-weight unitary assembly that may be used for compact profile displacement for vehicular communication or that attaches to a transportable communications handset. Notably, the above advantages are also provided while maintaining acceptable levels of performance.

Notably, the foregoing requires careful selection of a combination of factors. Namely, one of these factors is the layout of the conductors, which encompasses both the width of conductor portions in the circuit conductors and the routing/length of those conductors to define a distance of the proper wavelength. In addition, other factors include the use of inductors and their values, resulting in the appropriate resonance, and also include the tuning of the infinite balun to efficiently match the multiple frequencies. As will be appreciated by those skilled in the art, the foregoing factors influence the resultant electrical characteristics of the transmission line, including phase velocity, and hence the "in the line wavelength" determined for a signal of a particular frequency in contrast to the signals greater "free space" wavelength, and characteristic line impedance.

Moreover, the invention is not limited to location of the antenna feed used in the embodiment of FIGS. 1-3, which are seen to define a bottom fed antenna. Other known variations for feeding the antennas are conventional to quadrifilar helix antennas and also fall within the scope of the present invention, such as, for example, a top feed for the antenna. Moreover, it may be appreciated that in the practice of the invention the foregoing assembly is not required to contain both a transmit antenna and a receive antenna, it may contain one or the other or it may contain a plurality of transmit antennas and/or a plurality of receive antennas, all of which fall within the scope of the present invention. Also, any of the above embodiments may be combined, such as curved wires 30, ground adjusts 12, ground pinches 15, extension arms 28, etc.

It is believed that the foregoing description of the preferred embodiments of the invention is sufficient in detail to enable one skilled in the art to make and use the invention. However, it is expressly understood that the detail of the elements presented for the foregoing purposes is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A quadrifilar helix antenna comprising:

a set of four first antenna conductive elements tuned to resonate at a primary frequency, wherein the set of four first antenna conductive elements are substantially straight;

two or more sets of four second antenna conductive elements tuned respectively to resonate at two or more secondary frequencies, wherein the two or more sets of four second antenna conductive elements are arranged in a serpentine orientation;

a single feed system including a balun that has two connections for connecting to two out of four electrical leads corresponding to the first antenna elements and configured to provide and receive primary and secondary frequency signals, the electrical leads that are connected to the balun further connect at distal ends to distal ends of the electrical leads that correspond to the other two first antenna elements; and inductors or conductors placed between ends of the first antenna elements opposite from the single feed system and ends of adjacent second antenna elements opposite from the single feed system, the inductors or conductors providing resonant coupling of the secondary frequency signals between the second antenna elements and the first antenna elements.

2. The antenna of claim 1 wherein the single feed system comprises an infinite balun.

3. The antenna of claim 2 wherein the infinite balun is tuned to a frequency between the primary frequency and the two or more secondary frequencies.

4. The antenna of claim 3 wherein the infinite balun provides at the connections with the electrical leads of the two first antenna elements signals of different phase angles.

5. The antenna of claim 4 wherein the balun comprises an infinite loop that consists of electrically longer segments and electrically shorter segments, with one of the electrically longer segments spanning the connections and a second electrically longer segment spanning a corresponding section of an opposite side of the loop, and the electrically shorter segments of the loop have electrical lengths substantially equal to one quarter wavelength of the signal frequency for which the balun is tuned.

6. The antenna of claim 5 wherein the connection of the two first antenna elements that are connected to the balun with the other two first antenna elements at the distal ends provides ½ wavelength shorting.

7. The antenna of claim 1 wherein the second antenna elements resonate through the inductors or capacitors onto the first antenna elements received signals of the secondary frequencies and the first antenna elements provide the signals to the balun through the two connections;

the first antenna elements provide received signals of the primary frequency to the balun with little or no coupling to the second antenna elements;

the balun provides signals of the primary frequency for transmission through the two connections and the signals propagate through the first antenna elements; and the balun provides signals of the secondary frequencies for transmission through the two connections and the signals propagate through the first antenna elements and the inductors or capacitors to the secondary antenna elements.

8. The antenna of claim 1 wherein the first and second antenna elements are contained on a common planar surface area of an antenna substrate, and the antenna substrate is wrapped with the planar surface area forming a cylindrical surface.

9. The antenna of claim 1 further including ground adjusts that position connections to a ground plane at proximal ends of antenna elements of respective sets of the first antenna elements, the second antenna elements or both to selectively adjust the electrical lengths of the respective sets of antenna elements.

10. The antenna of claim 1 further including extension arms coupled to the first antenna elements, respective sets of second antenna elements, or both, to extend the electrical length, the bandwidth or both of the respective antenna elements.

11. A quadrifilar helix antenna comprising:

a set of four first antenna conductive elements tuned to resonate at a primary frequency, wherein the set of four first antenna conductive elements are substantially straight;

one or more sets of four second antenna conductive elements tuned respectively to resonate at one or more secondary frequencies, wherein the one or more sets of four second antenna conductive elements are arranged in a serpentine orientation;

ground shorts employed in respective sets of the first antenna elements, the second antenna elements or both, to connect the respective antenna elements at selected locations along the lengths of elements through an antenna substrate to a ground plane to provide corresponding shorter electrical lengths for the respective antenna elements; a single feed system including a balun that has two connections for connecting to two out of four electrical leads that correspond to the first antenna elements and configured to provide and receive primary and secondary frequency signals the electrical leads of the two first antenna elements further connecting at distal ends to distal ends of electrical leads corresponding to the other two of the first antenna elements; and inductors or capacitors placed between ends of the first antenna elements opposite the single feed system and ends of the second antenna elements opposite the single feed system, the inductors or capacitors providing resonant coupling of the secondary frequency signals between the first and second antenna elements.

12. The antenna of claim 11 further including ground adjusts that position connections to the ground plane at the ends of antenna elements of respective sets of the first antenna elements, the second antenna elements or both to selectively adjust the electrical lengths of the respective sets antenna elements.

13. The antenna of claim 11 wherein the single feed system comprises an infinite balun.

14. The antenna of claim 13 wherein the infinite balun is tuned to a frequency between the primary frequency and the one or more secondary frequencies.

15. The antenna of claim 14 wherein the infinite balun provides at the connections signals of different phase angles.

16. The antenna of claim 13 wherein the second antenna elements resonate through the inductors or capacitors onto the first antenna elements received signals of the secondary frequencies and the first antenna elements provide the signals to the balun through the two connections;

the first antenna elements provide received signals of the primary frequency to the balun through the two connections with little or no coupling to the second antenna elements;

the balun provides signals of the primary frequency for transmission through the two connections and the signals propagate through the first antenna elements; and the balun provides signals of the secondary frequencies for transmission through the two connections and the signals propagate through the first antenna elements and the inductors or capacitors to the secondary antenna elements.

17. The antenna of claim 13 wherein the balun comprises an infinite loop that consists of electrically longer segments and electrically shorter segments, with one of the electrically longer segments spanning the connections and a second electrically longer segment spanning a corresponding section of an opposite side of the loop and the electrically shorter segments of the loop have electrical lengths substantially equal to one quarter wavelength of the signal frequency for which the balun is tuned.

18. The antenna of claim 17 wherein the connection of the two first antenna elements that are connected to the balun with the other two first antenna elements at their distal ends provides ½ wavelength shorting.

19. The antenna of claim 11 wherein the first and second antenna elements are contained on a common planar surface area of an antenna substrate, the antenna substrate is wrapped with the planar surface area forming a cylindrical surface, and the ground shorts connect to a ground plane on an interior side of the wrapped antenna substrate.

20. The antenna of claim 11 further including extension arms coupled to the first antenna elements, respective sets of second antenna elements, or both, to extend the electrical length, the bandwidth or both of the respective antenna elements.

* * * * *